United States Patent [19]

Taber

[11] 4,126,327

[45] Nov. 21, 1978

[54] RACK AND GOLF CART

[76] Inventor: Russell E. Taber, 46 Crystal Cir., Ormond Beach, Fla. 32074

[21] Appl. No.: 798,102

[22] Filed: May 18, 1977

[51] Int. Cl.[2] ..... B62B 1/14

[52] U.S. Cl. ..... 280/47.26; 280/DIG. 6; 211/120

[58] Field of Search ..... 280/47.19, 47.2, 47.26, 280/47.35, DIG. 6, 47.33; 248/68 CB, 96, 98; 211/120, 60 G, 60 R, 60 T, 89; 150/1.5 B

[56] References Cited

U.S. PATENT DOCUMENTS

| | | | |
|---|---|---|---|
| 2,480,597 | 8/1949 | Nelson | 211/60 G |
| 2,530,307 | 11/1950 | Leach | 211/60 T |
| 2,551,009 | 5/1951 | Kaltenbach | 280/47.19 |
| 2,668,721 | 2/1954 | Wright | 280/47.33 X |
| 2,753,189 | 7/1956 | Conroy et al. | 211/60 G X |
| 3,014,760 | 12/1961 | Gard | 211/60 G UX |
| 3,552,598 | 1/1971 | Swingle | 211/120 |

FOREIGN PATENT DOCUMENTS

| | | | |
|---|---|---|---|
| 99,226 | 7/1964 | Denmark | 211/120 |

*Primary Examiner*—Joseph F. Peters, Jr.
*Assistant Examiner*—Norman L. Stack, Jr.
*Attorney, Agent, or Firm*—Bacon & Thomas

[57] ABSTRACT

A holder for golf clubs or similar articles is in the form of a continuous strip of flexible but resilient material fastened to a base at spaced points and bent, between those points, to define a series of adjacent loops to grip the articles between them. Each of the loops has a body of resilient foam within it to hold the loops yieldably distended. In one adaptation the holder is mounted on a golf pull cart having wheels foldable to a position where the pull cart can fit in the customary space on a motorized golf cart provided for golf bags. In another form the cart is provided with a pivoted leg for holding the cart in an upright position.

8 Claims, 13 Drawing Figures

RACK AND GOLF CART

BACKGROUND OF THE INVENTION

This invention is in the field of resilient holding devices, particularly for use on a golf pull cart.

One successful variety of pull cart allows the club heads to be kept fairly low by inserting them in flexible individual pockets which, nevertheless, prevent them from nesting close together, thus preventing a good selection of clubs within the less than 12 inch lateral space available on most powered golf carts. Several inventors have recognized some benefits derived from placing the club heads low but lacked solutions to the problem of holding the club shafts softly but firmly in compact parallel alignment so that the clubs will not vibrate or sway while the cart is in motion even if some clugs are elevated to various levels.

Many attempts have been made to provide golf carts having sufficient stability to be pulled over the terrain and yet being foldable to such compactness that they may be readily stored or mounted on motorized golf carts in the space provided. Prior art patents disclosing golf carts having some similarity to applicant's invention are U.S. Pat. Nos. 2,513,020, and 3,147,988.

Attempts have also been made to provide a satisfactory rack or holding device by folding strip material and mounting the same on a base. See, for example, U.S. Pat. Nos. 231,969, and 635,284.

SUMMARY OF THE INVENTION

A principal object of this invention is to provide a complete and compact golfing ensemble so that a golfer can transport and store all of his equipment with ease, whether he is walking with it, riding with it on a motorized cart or has to store it in a small closet or auto trunk space. In order to minimize the space requirements for such a device, the cart wheels can only be kept close together in use by keeping the center of gravity of the equipment, particularly the club heads, very low. Conventional folding carts are designed to keep the center of gravity fairly high over the axis of the wheels and, since the club heads extend to a substantial height above ground, the wheels must be spread wide to keep the assemblage from tipping over.

The present invention consists of a compact receptacle for golf clubs and golfers gear with a unique clamping or holding device for the clubs, and folding wheels. It is small enough to fit comfortably in the bag space on motorized golf carts and the wheels can be unfolded or folded for walking or not in a few seconds. Its low center of gravity makes it extremely stable and easy to pull, even with the wheels a foot or less apart. The clubs are fully exposed yet firmly gripped in an orderly line for easy removal and replacement.

The key element of the device is the clamping or holding structure for the club shafts. It is a strip of so-called rigid 14 mil polyester film, which in one example is 4½ inches wide and 44 inches long and is stapled, or otherwise fastened, at 4 inch intervals along its length, across a panel or base at 1 inch intervals of the panel width, except for ¼ inch intervals near each edge, to form a series of rounded loops between which the club shafts may be inserted and held by tension and friction.

Since the film loops could lose some of their tension from fatigue or if accidentially creased, two improved treatments have been devised which can be added singly or together to provide wide ranges of either tension or friction to grip the club shafts as desired. To increase tension, a piece of medium density polyurethane foam (2 to 3 lbs. per cubic foot) about 1½ inches square and 4 inches long was inserted lengthwise inside each loop of the clamps. To increase friction, a sheet of 150 inch thick low density polyurethane foam was laminated to the outer surface of the film before it was fastened in place. If either or both of these treatments is added, the film may be reduced in thickness to 10 or even 7½ mils.

A further object of the invention is to provide a clamp or holding device of the type described above, of general utility apart from a golf cart.

DESCRIPTION OF THE PREFERRED EMBODIMENTS

Figure 1:
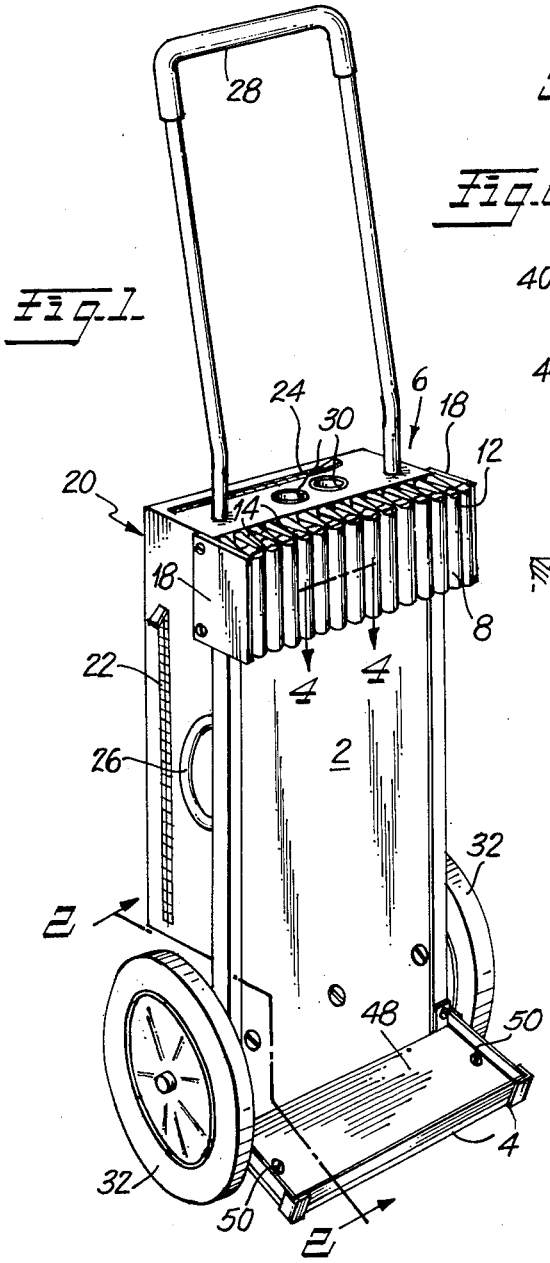
FIG. 1 is a perspective view of a golf cart employing applicant's novel holding means.

Referring first to FIGS. 1-4, the golf cart shown therein comprises a base member in the form of a flat rectangular panel 2 which may be of plywood or similar material having a downwardly and forwardly sloping tray 4 on its forward face and at the bottom end thereof. Near the top of the panel 2 a holding means, generally designated 6, is shown and which comprises an elongated strip 8 of suitable resilient plastic material such as that heretofore described, secured to the panel 2 at spaced positions thereacross by means such as the staples shown at 10 in FIG. 4. The material of the strip 8 between staples 10 is looped outwardly to define adjacent forwardly extending loops between which the shafts of golf clubs may be positioned to be frictionally held therein. Preferably, the interiors of the loops, indicated at 12, contain a slightly compressed body 14 of suitable foamed plastic material. As shown, the bodies 14 are normally of generally square sectional shape and of length about equal to that of the width of strip 8. When placed within the loops 12, they become slightly compressed and tend to hold the loops distended toward adjacent loops. If desired, the strips 8 may also be provided with a thin layer 16 of foamed plastic material on its outer surface to increase the frictional grip of the holding means on an article placed between the loops 12 without damaging or marring the same.

Rigid plates 18 are secured to the edges of the panel 2 at the ends of the holder 6 to thus retain the loops 12 of the holder all within the lateral confines of the panel 2 and to prevent their undue expansion or lateral flaring.

At the rear of the panel 2 there is provided means defining a hollow compartment, generally indicated at 20, for storage and transport of clothing or other golfing accessories. Access to the interior of the compartment may be provided by slide fasteners 22 or 24.

One edge of the panel 2 is also provided with a rigid handle 26 whereby the cart may be carried when collapsed in the manner to be described. Extending upwardly and rearwardly from the compartment 20 is a generally U-shaped pull handle 28 by which the user may manually tilt the cart rearwardly and pull the cart over a golf course.

One or more tubular holders 30 may be provided to extend downwardly from the upper surface of the compartment 20 and therethrough to any desired lower position and which may serve as holding means for a putter or further golfing accessories such as ball retrievers, umbrellas or the like.

Figure 2:
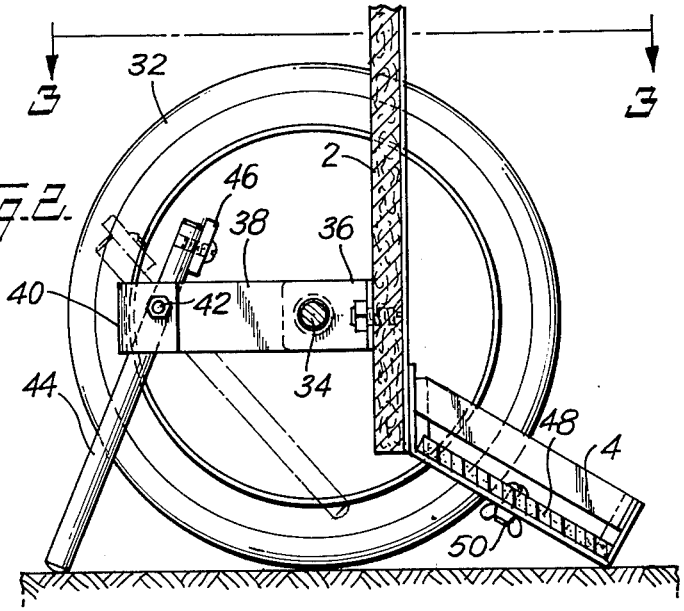
FIG. 2 is an enlarged fragmentary sectional view taken on the line 2—2 of FIG. 1.
Figure 3:
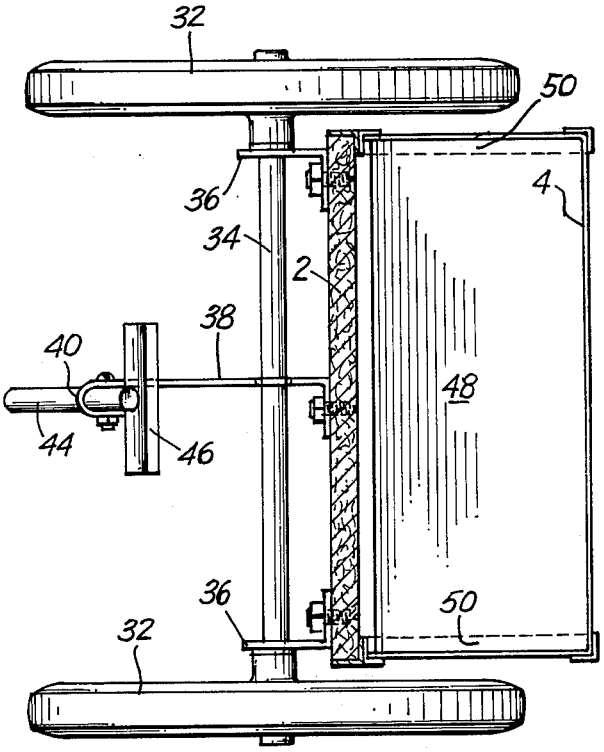
FIG. 3 is a horizontal sectional view taken on the line 3—3 of FIG. 2.

Referring now to FIGS. 2 and 3, ground wheels 32 are provided for the cart and are journalled on an axle 34. The axle 34 is supported by brackets 36 bolted to the panel 2 on the rear face thereof adjacent the bottom of the panel. A further bracket 38 is secured to the rear face of the panel 2 and extends rearwardly therefrom generally midway between the wheels 32 and to a rearmost position at or near the rear peripheral edge of the wheels 32. The rear end of the bracket 38 is reversely bent as shown at 40 and is provided with a pivot 42 upon which a strut or rod 44 is freely suspended between the bracket and its reversely bent end. The rod 44 may be of any suitable lightweight but rigid material and extends downwardly from the pivot 42 and also upwardly therefrom. The length of the strut 44 below pivot 42 is such that, when the rod is swung rearwardly to a position where it abuts the reversely bent end of the bracket 38, its lower end is substantially in the plane containing the bottom edge of wheels 32 and the forward and lower edge of tray 4. In this position it will be obvious that the strut 44 serves to maintain the golf cart upright and in a stable attitude. As is also apparent from FIG. 2, the rod 44 extends upwardly above pivot 42 and a relatively heavy counterweight 46 is fixed to its upper end. In the position shown in full lines in FIG. 2, the counterweight tends to hold the strut 44 in the illustrated inclined position. When it is desired to move the cart, all that is necessary for the user to do is to grasp the handle 28 and pull rearwardly thereon. The cart will then swing rearwardly with the strut 44 engaging the ground and which will itself swing rearwardly about its lower end as a pivot, lifting the wheels slightly, and permit the wheels to again drop onto the ground with the strut extending generally in the direction illustrated by dotted lines in FIG. 2 wherein the upper end portion of the strut engages the reversely bent end of bracket 38. It will be apparent that the weight 46 will not tend to hold the strut 44 in its dotted line position and particularly when the golf cart is tilted rearwardly for pulling along the ground. In that condition, the strut 44 will extend generally horizontally. In some cases, the cart may be provided with two of the pivoted struts, one near each of the wheels 32.

As best shown in FIG. 2, it is contemplated that the tray 4 be provided with a removable bottom layer 48 of foamed plastic material to provide better frictional retention of golf club heads against crowding together or sliding thereon. The layer 48 is preferably made removable, by means of bolts and wing nuts 50 whereby it may be cleaned and replaced.

Figure 5:
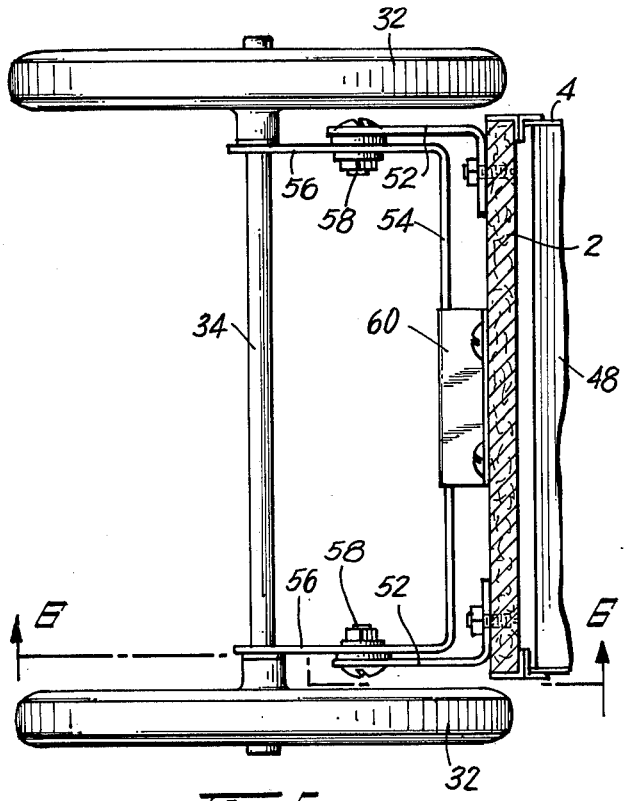
FIG. 5 is a view similar to FIG. 3 but showing a modified form of wheel mount.
Figure 6:
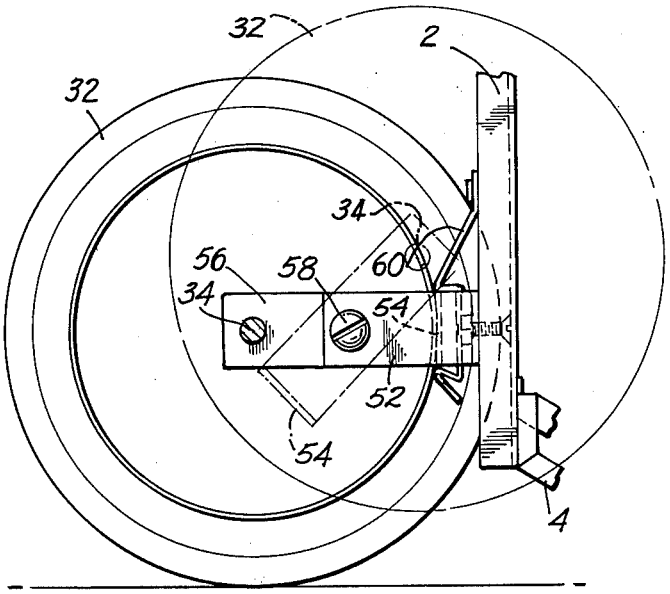
FIG. 6 is a side elevational view of the modification shown in FIG. 5.

In the modification shown in FIGS. 5 and 6, the rear of the panel 2 is provided with a pair of brackets 52 at its outer edges and wheels 32 and axle 34 are mounted on a further generally U-shaped bracket 54. The side arms 56 of bracket 54 are journalled intermediate their ends on the brackets 52 by suitable pivot means 58 at the outer ends of brackets 52. Thus, the bight portion of bracket 54 may be positioned closely adjacent the panel 2 to position the wheels 32 in the full line position shown in FIG. 6. A spring latch 60 is secured to the panel 2 and is configured to embrace and retain the bracket 54 in the described position for normal use of the cart. The spring latch 60, however, may be depressed at its lower end to release the bracket 56 and permit the same to swing about pivots 58 to the dotted line position of FIG. 6. It is to be noted that the wheels 32 lie in planes outwardly of the edges of panel 2 so that they may swing past the edges of that panel to the dotted line position of FIG. 6. Obviously, in their dotted line position the golf cart is more compact and more readily stored.

Figure 7:
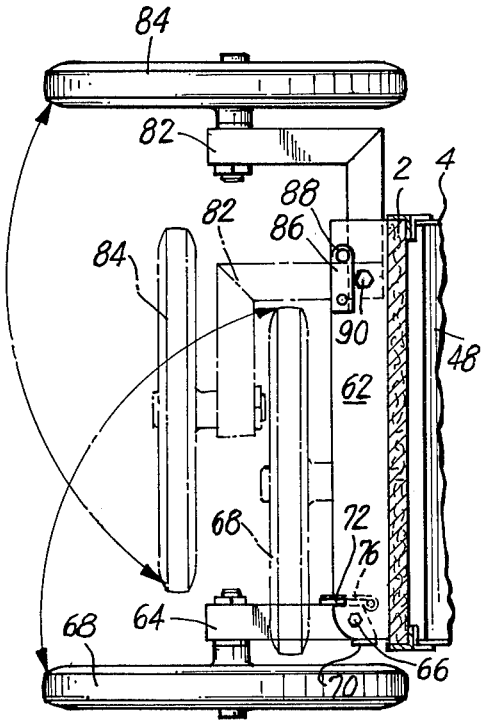
FIG. 7 is a view similar to FIG. 5 but showing a still further modification of wheel mounting means.
Figure 8:
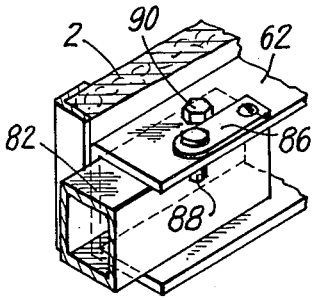
FIGS. 8 and 9 are perspective detailed views of portions of FIG. 7.
Figure 9:
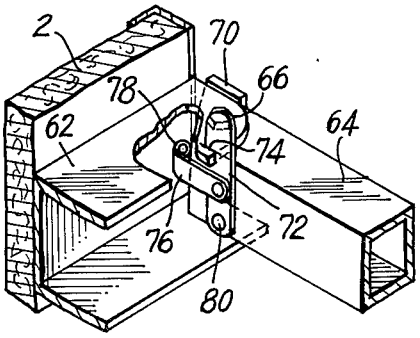

Referring now to FIGS. 7–9, a third modification of wheel mounting means is shown. In this form of the device, a rearwardly open transverse channel member 62 is secured to the rear face of panel 2 and extends substantially from one edge to the other of the panel adjacent its lower end. A first arm 64 carried by pivot 66 is pivotal relative to the channel 62 and has a ground wheel 68 journalled at the rear end thereof. A flange portion 70 on arm 64 engages an end edge of channel 62 to the outward swinging movement of the arm relative to channel 62 and a pivoted latch 72 carried by arm 64 may be engaged in a slot 74 in the channel 62 to hold the arm in the illustrated rearwardly extending position. The pivoted latch 72 has a forwardly extending spring 76 provided at its free end with a loop 78. It will be obvious that the latch 72 may be forcibly swung rearwardly about its pivot 80 and thus deflect the loop 78 outwardly to permit releasing the latch from slot 74. Upon return of the latch, to the position shown in FIG. 9, loop 28 will snap behind the rear end edge of arm 64 to releasably hold the latch in position. When latch 72 is released, arm 64 may be swung inwardly to lie within channel 62 and thus position wheel 68, as shown in broken lines in FIG. 7, so that the wheel lies rearwardly of panel 2 and generally parallel thereto.

A second and L-shaped arm 82 is pivoted in the other end portion of channel 62 and is so configured that when in the full line position of FIG. 8, its wheel is parallel to the wheel 68 when the latter is in its full line position. Leaf spring 86 (FIG. 8) carries a pin 88 freely movable through aligned opening in the upper flange of channel 62 in such position as to extend downwardly behind arm 82 and hold arm 82 in the full line position of FIG. 7. Obviously, the pin 88 may be lifted to permit the arm 82 to swing to the dotted line position of FIG. 7, wherein its wheel 84 lies rearwardly of the folded wheel 68 and generally parallel thereto. In this position, as seen from FIG. 7, the pin 88 will hold leg 82 in its dotted line position. In the folded positions described, the golf cart is of minimum width and the wheels will permit the cart to stand upright, the wheels acting as supporting struts. Also, the cart may be moved laterally by tilting the same slightly rearwardly to throw the weight onto the folded wheels 84 and 68.

Figure 11:
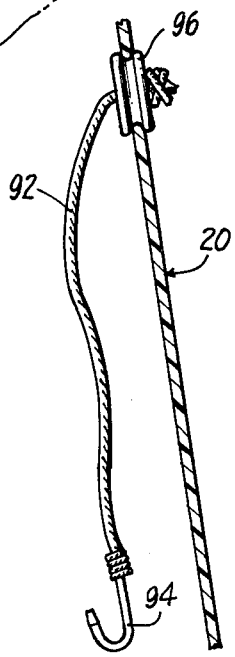
FIG. 11 is a fragmentary sectional view on line 12—12 of FIG. 10.
Figure 10:
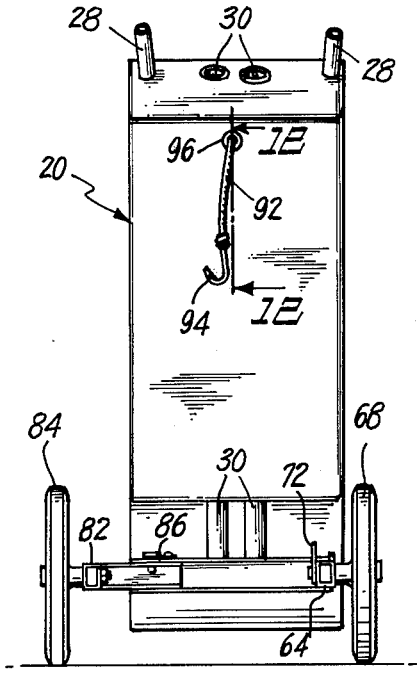
FIG. 10 is a rear view of a golf cart embodying the present invention.

The cart of the present invention may be constructed to hold the permitted number of golf clubs and yet be of sufficiently narrow dimensions as to be readily received in the usual space provided for golf bags on motorized golf carts. However, such motorized golf carts are conventionally provided with straps adapted to extend around a golf bag to hold the same in place. Obviously, such straps if employed with the present golf cart would interfere with removal of the clubs from holder 6. To adapt the cart to such use it is contemplated that it be provided with a knotted elastic cord 92, as shown in FIGS. 10 and 11, slidable through an eyelet 96 in the rear wall of the compartment 20 and provided with a hook or the like 94 at its outer end whereby it may be engaged with a portion of the motorized golf cart to hold the device in place thereon without the use of the usual straps.

Figure 4:
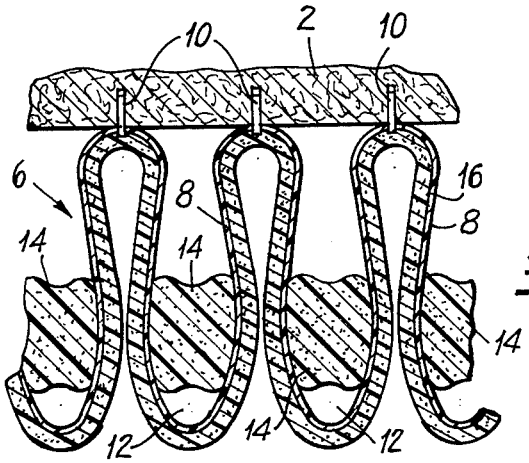
FIG. 4 is an enlarged fragmentary sectional view taken on the line 4—4 of FIG. 1.
Figure 12:
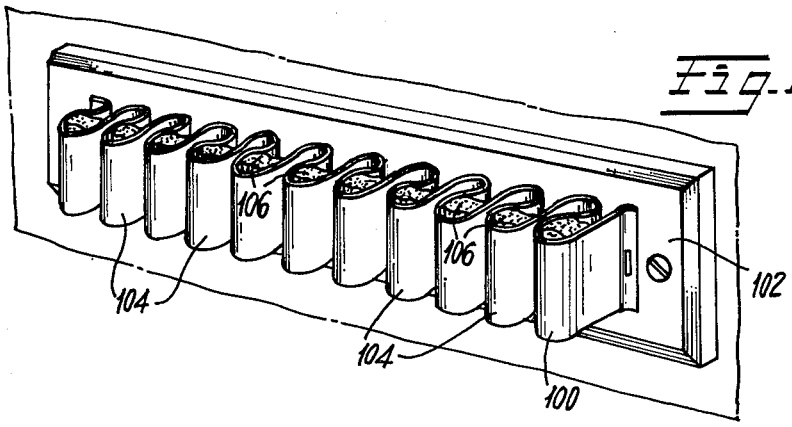
FIG. 12 is a perspective view of the invention embodied in a holding rack of general utility.

The foregoing description relates to specific uses for the holding means 6, previously described. Such holding means, however, are adapted to more general use than on golf carts and FIG. 12 illustrates one embodiment wherein a length of flexible strip material 100 is secured at spaced positions to a supporting base 102 to define loops 104 similar to those previously described. Also shown are the bodies 106 of resilient foam material within the loops 104 for the purpose already described. The base 102 may be secured to any suitable support and the device may be employed to releasably hold any desired articles capable of being received between and frictionally held by the loops 104. If desired, the outer surface of the strip 100 may also be provided with the layer of plastic foam material as shown in FIG. 4 and as already described.

Figure 13:
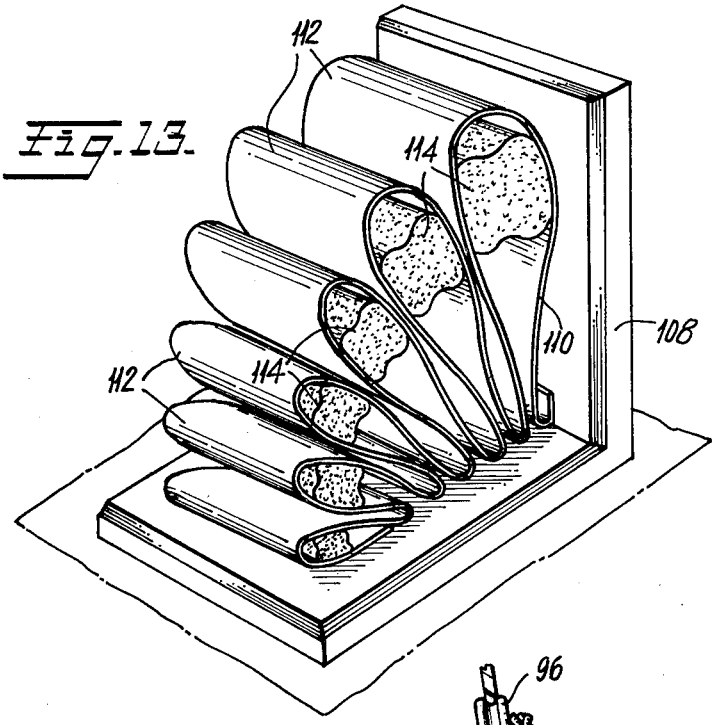
FIG. 13 is a perspective view of a modified form of holding rack of general utility.

FIG. 13 shows a second embodiment of a holding means of general utility but one that may be placed on a table or desk top. In this form a generally L-shaped rigid base member 108 has the strip of material 110 secured thereto in the manner already described but arranged to define elongated loops 112 arranged to generally radiate from the inner corner of the base 108, all as clearly shown in FIG. 13. Here again, the loops are preferably provided with the internal foamed material 114 to hold the loops laterally distended and ensure good frictional grip with articles placed therebetween. Again, the strip 110 may be provided with a layer of foamed material on its outer surface if desired or necessary.

While a limited number of specific embodiments of the invention have been shown and described herein, the same are merely illustrative of the principles involved and other forms may be devised within the scope of the appended claims.

I claim:

1. A golf cart comprising:

a rigid panel having upper and lower ends;

a pair of ground wheels mounted on said panel at its lower end and at the rear side thereof;

a pull handle member extending from the upper end portion of said panel;

a tray extending from the front side of said panel at the lower end thereof for receiving the heads of golf clubs;

clamping means on said front side of said panel, adjacent the upper end thereof, said clamping means comprising a strip of flexible resilient plastic material secured to said panel at spaced points thereacross, the material of said strip between said spaced points defining forwardly extending resilient loops of a height greater than their lateral spacing, adjacent loops being sufficiently close together to conform to and frictionally receive and hold the shaft of a golf club therebetween; and a body of resilient material in each of said loops holding said loops yieldably expanded toward adjacent loops.

2. A golf cart as defined in claim 1 including forwardly extending side plates on said panel, at the ends of said clamping means, confining said loops to substantially the width of said panel.

3. A golf cart as defined in claim 1 including means on the rear of said panel, above said wheels defining a storage compartment.

4. A golf cart as defined in claim 3 including at least one open topped tubular accessory holder extending downwardly through said compartments.

5. A golf cart as defined in claim 1 including a bracket secured to the rear of said panel to extend rearwardly therefrom between said wheels;

a rod freely pivoted to the rear of said bracket on a horizontal axis;

a biasing weight on said rod above said axis; and stop means on said bracket engageable with said rod to limit pivotal movement thereof between a first position, where said rod extends downwardly and rearwardly of said wheels to engage the ground and support said cart in a generally upright attitude, and a second position extending forwardly between said wheels, said biasing weight serving to hold said rod in each of said positions.

6. A golf cart as defined in claim 1 wherein said wheels are journalled on separate rearwardly extending arms pivoted to the rear of said panel on vertical axes, said arms pivoted to the rear of said panel on vertical axes, said arms being so configured and dimensioned that one of said arms may be swung inwardly to position a first wheel behind said panel and parallel thereto, the other of said arms, when swung inwardly, positioning its wheel behind said first wheel and parallel thereto.

7. A golf cart as defined in claim 6 including releasable latch means holding each of said arms in its rearwardly extending position.

8. A golf cart as defined in claim 1 wherein said wheels are journalled on an axle extending between the legs of a generally U-shaped bracket having its bight portion adjacent the rear of said panel and with said wheels normally behind said panel but outwardly of the edges thereof;

rearwardly extending supports on said panel pivotally supporting mid portions of the legs of said U-shaped bracket; and releasable latch means holding said bight portion adjacent said panel and thereby holding said bracket against pivoting on said supports.

* * * * *